US006860776B2

(12) United States Patent
Kai et al.

(10) Patent No.: US 6,860,776 B2
(45) Date of Patent: Mar. 1, 2005

(54) METHOD FOR PRODUCING HIGH PRESSURE DISCHARGE LAMP UNIT AND APPARATUS FOR PRODUCING THE SAME

(75) Inventors: Makoto Kai, Osaka (JP); Makoto Horiuchi, Nara (JP); Kiyoshi Takahashi, Kyoto (JP); Yuriko Kaneko, Nara (JP); Shinichiro Hataoka, Osaka (JP); Tsuyoshi Ichibakase, Osaka (JP); Tomoyuki Seki, Osaka (JP); Kenichi Sasaki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 142 days.

(21) Appl. No.: 10/241,109

(22) Filed: Sep. 11, 2002

(65) Prior Publication Data

US 2003/0049991 A1 Mar. 13, 2003

(30) Foreign Application Priority Data

Sep. 11, 2001 (JP) ..... 2001-274599

(51) Int. Cl.[7] ..... H01J 9/42
(52) U.S. Cl. ..... 445/4; 445/64
(58) Field of Search ..... 445/3, 4, 63, 64

(56) References Cited

U.S. PATENT DOCUMENTS 3,737,960 A * 6/1973 Billson ..... 445/4
5,059,146 A * 10/1991 Thomas et al. ..... 445/4
5,230,647 A * 7/1993 Namba ..... 445/64

FOREIGN PATENT DOCUMENTS

| | | |
|---|---|---|
| JP | 04114140 A | 4/1992 |
| JP | 05313117 A | 11/1993 |
| JP | 07128739 A | 5/1995 |
| JP | 2001-166382 | 6/2001 |
| WO | WO 00/58786 | 10/2000 |

OTHER PUBLICATIONS

Notice of Reasons for Rejection for JP 2002–253792 dated Jan. 20, 2004.

* cited by examiner

*Primary Examiner*—Kenneth J. Ramsey
(74) *Attorney, Agent, or Firm*—Harness, Dickey & Pierce, P.L.C.

(57) ABSTRACT

A method for producing a high pressure discharge lamp unit including a high pressure discharge lamp set and fixed to a reflecting mirror includes the steps of detecting light released from a point-like light source and reflected at a reflecting surface of the reflecting mirror to determine a position for setting that is a position of the point-like light source in which the reflected light is substantially the maximum; identifying a predetermined position between electrodes of the high pressure discharge lamp; and matching the predetermined position to the position for setting.

15 Claims, 2 Drawing Sheets

METHOD FOR PRODUCING HIGH PRESSURE DISCHARGE LAMP UNIT AND APPARATUS FOR PRODUCING THE SAME

BACKGROUND OF THE INVENTION

The present invention relates to a method for producing a high pressure discharge lamp unit and an apparatus for producing the same. In particular, the present invention relates to a method for producing a high pressure discharge lamp unit including a high pressure discharge lamp set and fixed inside a reflecting mirror used as a projector and an apparatus for producing the same.

An example of conventional methods for producing a high pressure discharge lamp unit having a high pressure discharge lamp (hereinafter, referred to simply as "lamp") set and fixed inside a reflecting mirror is disclosed in Japanese Laid-Open Patent Publication No. 5-313117. FIG. 4 shows the procedure of a method for fixing a lamp to a reflecting mirror disclosed in the publication.

Referring to the procedure shown in FIG. 4, first, a lamp is set in a predetermined position with respect to a reflecting mirror, and then, taking a direction in which light emits from the reflecting mirror as the Z axis direction, and directions orthogonal to each other on a plane perpendicular to the Z axis as the X axis direction and the Y axis direction, the position of the lamp is adjusted while comparing the positions of the three axes directions to the illuminance characteristics of emitted light on a screen. Thereafter, the lamp is fixed to the reflecting mirror.

However, in the conventional method, a lamp that is desired to be actually set and fixed is used to determine a position in which the lamp is provided, so that some time (about 5 to 10 minutes) until the amount of light emitted from the lamp is stabilized is required before the start of the positioning work. Some more time is required for actual positioning work, and therefore the problem of inefficiency of production is caused.

Furthermore, although reflecting mirrors to which lamps are desired to be actually set have a difference in the reflecting characteristics due to individual internal shapes or reflecting films, this method can evaluate the illumination characteristic only by the illuminance on the screen in the state in which the lamp is set and fixed to the reflecting mirror. Therefore, when the illumination characteristics do not reach a predetermined illuminance, it cannot be determined whether it is caused by the malfunction of the lamp or the malfunction of the reflecting mirror.

SUMMARY OF THE INVENTION

Therefore, with the foregoing in mind, it is a main object of the present invention to provide a method for producing a high pressure discharge lamp unit that can improve production efficiency and an apparatus for producing the same. It is another object of the present invention to provide a method for producing a high pressure discharge lamp unit that can improve production efficiency, evaluate and screen the characteristics of a high pressure discharge lamp and a reflecting mirror independently during production, and realize at any suitable time an appropriate combination of the high pressure discharge lamp and the reflecting mirror among a plurality of high pressure discharge lamps and a plurality of reflecting mirrors, and an apparatus for producing the same.

A method for producing a high pressure discharge lamp unit including a high pressure discharge lamp set and fixed to a reflecting mirror of the present invention includes the steps of detecting light released from a point-like light source and reflected at a reflecting surface of the reflecting mirror to determine a position for setting that is a position of the point-like light source in which the reflected light is substantially the maximum; identifying a predetermined position between electrodes of the high pressure discharge lamp; and matching the predetermined position to the position for setting.

It is preferable that the step of identifying a predetermined position includes the step of identifying the predetermined position as three-dimensional information.

It is preferable that the step of identifying a predetermined position includes the step of further identifying an electrode shape of the high pressure discharge lamp as three-dimensional information.

It is preferable that the method further includes the step of evaluating and screening the high pressure discharge lamp in accordance with a predetermined criterion, based on information on the predetermined position that is identified.

It is preferable that the step of determining a position for setting includes the step of detecting the reflected light as two-dimensional information.

It is preferable that the method further includes the step of evaluating and screening the reflecting mirror in accordance with a predetermined criterion, based on information on the reflected light that is detected.

It is preferable that the method further includes the step of combining a single high pressure discharge lamp and a single reflecting mirror in accordance with a predetermined criterion among a plurality of high pressure discharge lamps and a plurality of reflecting mirrors, based on information on the predetermined position that is identified and information on the reflected light that is detected.

In one embodiment, the reflecting mirror has a substantially ellipsoidal reflecting surface, and the maximum diameter of the reflecting surface of the reflecting mirror is less than 40 mm.

An apparatus for producing a high pressure discharge lamp unit including a high pressure discharge lamp set and fixed to a reflecting mirror of the present invention includes a point-like light source; a first varying device for varying a position of the point-like light source; a detecting device for detecting light emitted from the point-like light source and reflected at a reflecting surface of the reflecting mirror; an identifying device for identifying a predetermined position between electrodes of the high pressure discharge lamp; and a second varying device for matching the predetermined position to a position for setting that is a position of the point-like light source determined by the detecting device in which the reflected light is substantially a maximum.

It is preferable that the identifying device has a function of identifying the predetermined position between electrodes of the high pressure discharge lamp as three-dimensional information.

It is preferable that the identifying device has a function of further identifying an electrode shape of the high pressure discharge lamp as three-dimensional information.

It is preferable that the apparatus further includes lamp evaluating and screening means for evaluating and screening the high pressure discharge lamp in accordance with a predetermined criterion, based on information identified by the identifying device.

It is preferable that the detecting device has a function of detecting the reflected light as two-dimensional information.

It is preferable that the apparatus further includes reflecting mirror evaluating and screening means for evaluating and screening the reflecting mirror in accordance with a predetermined criterion, based on information detected by the detecting means.

It is preferable that the apparatus further includes combination instructing means for combining a single high pressure discharge lamp and a single reflecting mirror in accordance with a predetermined criterion among a plurality of high pressure discharge lamps and a plurality of reflecting mirrors, based on information from the lamp evaluating and screening means and the reflecting mirror evaluating and screening means.

The present invention includes the step of determining the position for setting that is the position of the point-like light source in which the reflected light is substantially the maximum, the step of identifying a predetermined position between the electrodes of the high pressure discharge lamp, and the step of matching the predetermined position to the position for setting. Therefore, it is not necessary to use a lamp that is desired to be actually set and fixed for determining the position to which the lamp is set. As result, the production efficiency can be improved, and it can be determined whether malfunction is occurring in a lamp or a reflecting mirror. When the present invention further includes the step of evaluating and screening a high pressure discharge lamp in accordance with a predetermined criterion, based on information on the predetermined position that is identified, this step makes it possible to evaluate and screen a high pressure discharge lamp, comparing to the actual production quality. Furthermore, when the present invention further includes the step of combining a single lamp and a single reflecting mirror in accordance with a predetermined criterion among a plurality of high pressure discharge lamps and a plurality of reflecting mirror, based on information on the predetermined position that is identified and information on reflected light that is detected, the yield can be improved further or the number of products of different ranks can be planned and controlled, for example, by combining a comparatively poor performance reflecting mirror that is in the acceptable specification range with a comparatively good performance lamp that is in the acceptable specification range.

An apparatus for producing a high pressure discharge lamp unit of the present invention includes a point-like light source; a first varying device for varying a position of the point-like light source; a detecting device for detecting light emitted from the point-like light source and reflected at a reflecting surface of the reflecting mirror; an identifying device for identifying a predetermined position between electrodes of the high pressure discharge lamp; and a second varying device for matching the predetermined position to a position for setting that is a position of the point-like light source determined by the detecting device in which the reflected light is substantially the maximum. Therefore, the present invention can provide an apparatus for producing a high pressure discharge lamp unit that can determine poor characteristics of a reflecting mirror alone without using a high pressure discharge lamp to be actually set and fixed. As a result, the production efficiency can be improved. When the present invention further includes lamp evaluating and screening means for evaluating and screening the high pressure discharge lamp in accordance with a predetermined criterion, based on information identified by the identifying device, the present invention can provide an apparatus for producing a high pressure discharge lamp unit that can evaluate and screen a high pressure discharge lamp, comparing to the actual production quality. When the present invention further includes combination instructing means for combining a single high pressure discharge lamp and a single reflecting mirror in accordance with a predetermined criterion among a plurality of high pressure discharge lamps and a plurality of reflecting mirror, based on information from the lamp evaluating and screening means and the reflecting mirror evaluating and screening means, the present invention can provide an apparatus for producing a high pressure discharge lamp unit having a further improved yield or enabling the number of products of different ranks to be planned and controlled, for example, by combining a comparatively poor performance reflecting mirror that is in the acceptable specification range with a comparatively good performance lamp that is in the acceptable specification range.

The method for producing a high pressure discharge lamp of the present invention can improve the production efficiency, because the present invention includes the step of determining the position for setting that is the position of the point-like light source in which the reflected light is substantially the maximum, the step of identifying the predetermined position between the electrodes of the high pressure discharge lamp, and the step of matching the predetermined position to the position for setting.

DETAILED DESCRIPTION OF THE INVENTION

Figure 1:
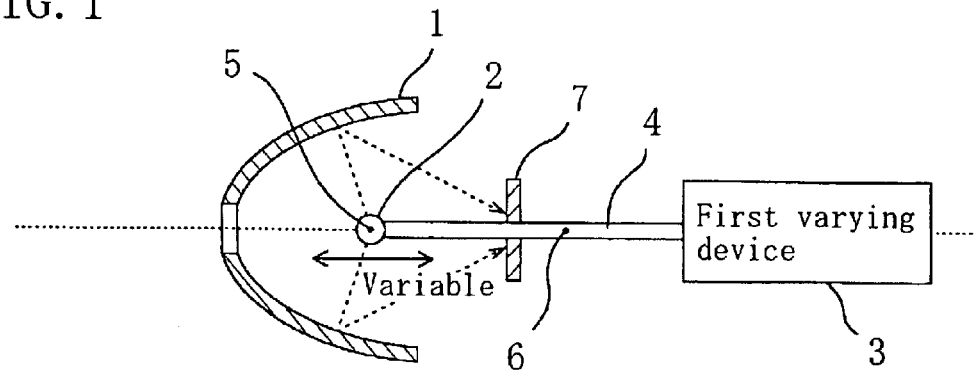
FIG. 1 is a schematic view of a production apparatus in a procedure (1) in Embodiment 1 of the present invention.

Hereinafter, embodiments of the present invention will be described with reference to the accompanying drawings. For simplification, in the following drawings, the elements having substantially the same function bear the same reference numerals. The present invention is not limited to the following embodiments.

Embodiment 1

Figure 2:
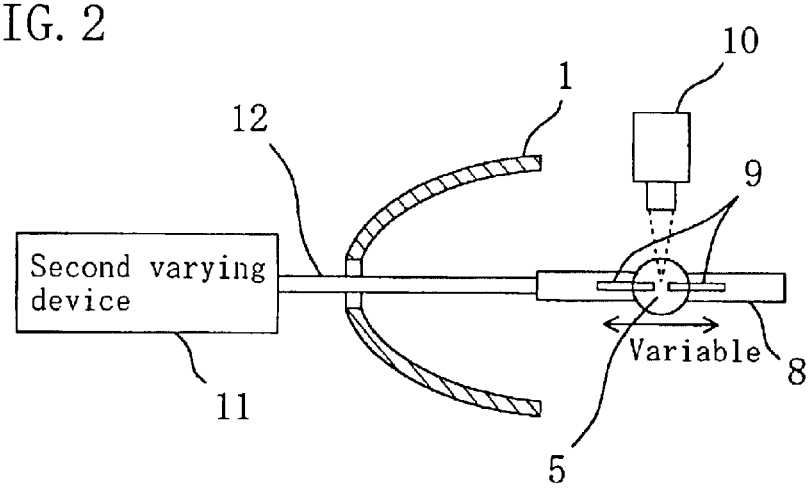
FIG. 2 is a schematic view of a production apparatus in a procedure (2) in Embodiment 1 of the present invention.
Figure 3:
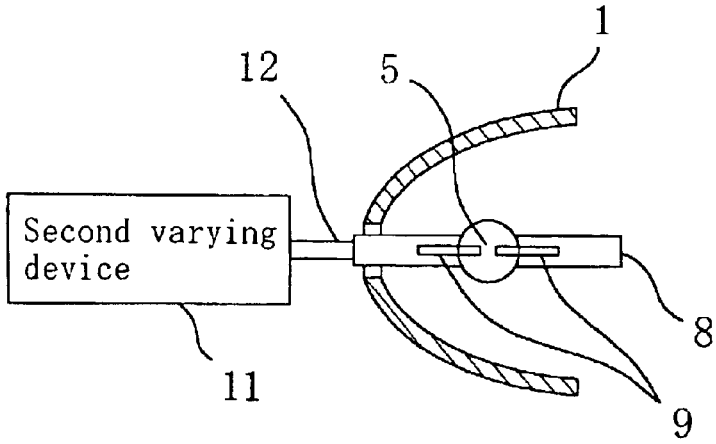
FIG. 3 is a schematic view of a production apparatus in a procedure (3) in Embodiment 1 of the present invention.
Figure 4:
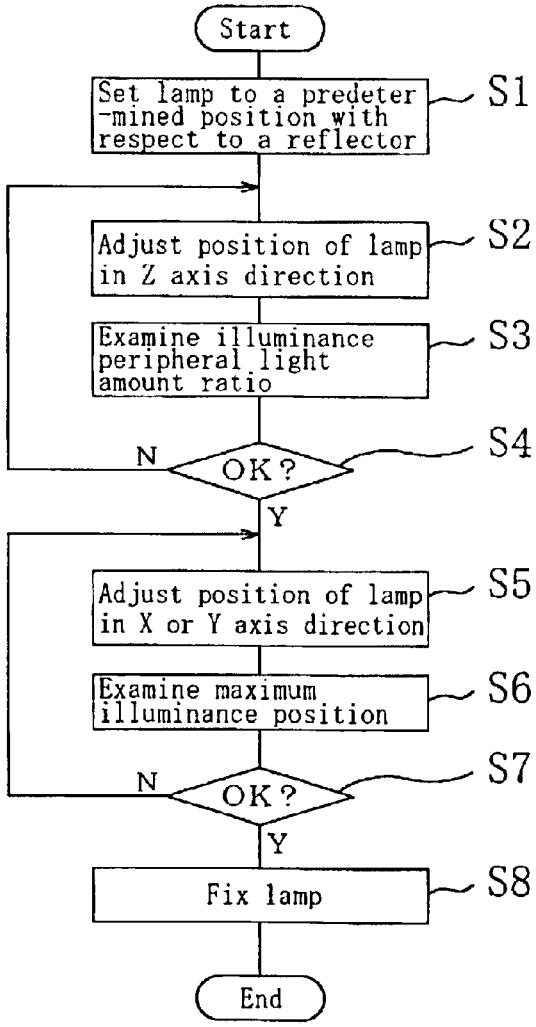
FIG. 4 is a flowchart describing a procedure of a conventional method for fixing a lamp and a reflector.

FIGS. 1 through 3 are schematic views showing a method for producing a high pressure discharge lamp unit provided with a high pressure discharge lamp set and fixed to a reflecting mirror of this embodiment.

The method for producing a lamp unit of this embodiment includes the step of detecting light released from a point-like light source 2 and reflected at the reflecting surface of a reflecting mirror 1 to determine a position for setting that is a position in the point-like light source 2 in which the reflected light is substantially the maximum. (procedure (1); see FIG. 1), the step of identifying a predetermined position between the electrodes 9 of a high pressure discharge lamp 8 (procedure (2); see FIG. 2), and the step of matching the predetermined position to the position for setting (procedure (3); see FIG. 3). The production method of the present invention makes it possible to determine poor characteristics of the reflecting mirror alone without using a high pressure discharge lamp that is actually set and fixed, and therefore the production efficiency can be improved. Further description is presented below.

FIG. 1 is a view for describing the processes of the procedure (1) and shows a reflecting mirror 1 that is combined with a high pressure discharge lamp and a point-like light source 2 whose luminous portion is point-like. The point-like light source 2 is variable and is connected to a first varying device (first varying means) 3 via a supporting member 4.

The reflecting mirror 1 has a spheroidal shape and has a first focus position 5 that is defined by design specification on the reflecting surface and a second focus position 6 outside the opening face. A photodetector 7 that can detects an amount of reflected light emitted from the point-like light source 2 and reflected at the inner surface of the reflecting mirror 1 is provided in the vicinity of the second focus position 6. The point-like light source 2 is, for example, an optical fiber light source that is guided from the other end and shines, and the luminous portion is provided in a position including the first focus position 5. The position of the luminous portion of the point-like light source 2 is identified and controlled by the first varying device 3 and it also identifies spatial positional relationship to the reflecting mirror 1. The amount of light emitted from the luminous portion is controlled to be constant.

The light from the luminous portion provided in the position including the first focus position 5 first is reflected at the inner surface of the reflecting mirror 1, is focused on the vicinity of the second focus position 6 and is detected by the photodetector 7. The photodetector 7 is, for example, a photodiode. The position of the photodetector 7 corresponds to a light-entering position through which light emitted from the luminous portion of a provided light source and reflected in the reflecting mirror 1 passes and then enters a projecting optical system, for example, in a projector. When producing a product such as a projector, the light-entering position generally is determined based on its positional relationship to a predetermined portion (e.g., glass shell end portion in the opening portion) of the outline of the reflecting mirror 1. In other words, if the reflecting mirrors are produced with no error or variation each other in the outer shape of the reflecting mirror 1 and the inner surface shape of the reflecting mirror 1, the positional relationship between the second focus position 6 of the reflecting mirror 1 and the predetermined position of the outline of the reflecting mirror 1 is uniquely determined, and the positional relationship between the position for setting of the optical system for incident light and the predetermined position of the outline of the reflecting mirror 1 is uniquely determined such that all light emitted from the first focus position 5 is focused on the second focus position 6. In this state, the photodetector 7 indicates the maximum value. For example, the photodetector 7 has a flat circular surface as a light-receiving surface and is provided on a plane parallel to the opening face of the reflecting mirror including the second focus position 6, and detects the luminous flux (illuminance) per unit area of the light reflected at the inner surface of the reflecting mirror 1.

Regarding setting with consideration on examinations of actual lamp units, the following can be said. Practical reflecting mirrors 1 have a variation each other in the inner surface shape, the outer shape and the reflectance of the inner surface of the reflecting mirror 1, so that even if the positional relationship between the predetermined portion of the outline of the reflecting mirror 1 and the light-entering position for light to enter a projecting optical system is previously determined for production of products such as projectors, the position for setting the luminous portion in which the photodetector 7 detects the maximum illuminance is not necessarily matched to the first focus potion 5.

That is to say, it is most preferable that the photodetector 7 is provided in the light-entering position in a predetermined position with respect to a predetermined portion of the outline of the reflecting mirror 1 (more specifically, the light-entering position of an optical system for projection that is previously determined for production of products such as projectors), and the value indicated by the photodetector 7 is the maximum. In other words, if the high pressure discharge lamp can be set and fixed to the reflecting mirror 1 such that the maximum value is indicated, the performance of the high pressure discharge lamp can be better. Therefore, it is not very significant as a product whether or not the light-emitting is provided in the first focus position 5 of the reflecting mirror, and it is rather significant that the indicated value obtained as a result of combining a certain lamp and a certain reflecting mirror meets the conditions satisfying the production specification. Thus, if the position for setting of the luminous portion of the point-like light source in which the photodetector 7 detects the maximum illuminance is identified in an individual reflecting mirror 1, the luminous portion of the high pressure discharge lamp can be matched to that position.

In the procedure (1) of this embodiment, according to the above-described reasoning, the position for setting of the luminous portion of the point-like light source in which the photodetector 7 provided in the light-entering position of the optical system for incident light for projection detects the maximum illuminance is detected and determined. In some cases, for example, in the case where the reflectance at the inner surface of the reflecting mirror 1 is reduced, even the maximum amount of light may not satisfy a predetermined illuminance when light is illuminated on a screen. Such poor characteristics of the reflecting mirror 1 alone can be detected and screened based on the indicated value of the photodetector 7 by using a point-like light source without using a high pressure discharge lamp to be set and fixed. In this case, reflecting mirror evaluating and screening means for evaluating and screening whether a reflecting mirror is non-defective or defective, comparing to the specification of the reflecting mirror 1, based on the indicated value of the photodetector 7 can be provided. The reflecting mirror evaluating and screening means (or reflecting mirror evaluating and screening device) can be realized by a computer that evaluates and screens whether a reflecting mirror is non-defective or defective, comparing to the specification of the reflecting mirror 1, based on the indicated value of the photodetector 7, for example, in the structure shown in FIG. 1.

If, for example, a CCD camera is used, instead of a single flat surface, as the light-receiving surface of the photodetector 7, the illuminance distribution as two-dimensional information can be obtained. By doing this, for example, in the case of a non-defective reflecting mirror 1 having good focusing performance, a concentrical illuminance distribution in which high peaks appear in the center in a narrow range can be obtained. In the case of a defective reflecting mirror 1 having poor focusing performance, a concentrical illuminance distribution in which low peaks appear in a broad range can be obtained. When the outline of the reflecting mirror 1 is distorted, the concentrical illuminance distribution is accordingly distorted, so that the focusing performance is deteriorated. Thus, based on two-dimensional information, it is possible to evaluate and screen whether the reflecting mirror 1 is non-defective or defective on more definite criterion.

Next, the procedure (2) will be described with reference to FIG. 2. In the procedure (2), the position of the luminous portion of an individual high pressure discharge lamp 8 is identified by another means. More specifically, in order to set the luminous portion of an actual high pressure discharge lamp in the position (that is, the position in which the luminous portion of the high pressure discharge lamp 8 is to be set) that has been determined in view of variations in shape of reflecting mirrors and variations in reflectance, using the point-like light source 2 in the procedure (1), the position of the individual high pressure discharge lamp 8 is identified by another means in this procedure (2).

The distance between the electrodes 9 of the high pressure discharge lamp 8 used for projectors is preferably about 1 mm in view of light utilization and this is actually used. The discharge arc that emits light with a distance between electrodes of about 1 mm constitutes a point-like light source, and it is advantageous in view of light utilization to primarily utilize light emission in the central portion between the electrodes.

Therefore, in the procedure (2) of this embodiment, the predetermined portion (e.g., position of the center between the electrodes) between the electrodes 9 of an individual unlit high pressure discharge lamp 8 is determined by, for example, an image identifying device (image identifying means) 10 provided near the high pressure discharge lamp 8. The image identifying device 10 can be configured with, for example, a CCD imaging device (CCD camera), or a MOS imaging device.

As shown in FIG. 2, the high pressure discharge lamp 8 is supported by a supporting member 12 coupled to a second varying device (second varying means) 11. In other words, the high pressure discharge lamp 8 is coupled to a second varying device (second varying means) 11 via a supporting member 12 so as to be variable.

In the actual high pressure discharge lamp 8, metal electrodes (e.g., tungsten electrodes) 9 are opposed in a transparent quartz glass vessel, and discharge occurs between the electrodes 9. Therefore, identification is possible with an image through the quartz glass even when the lamp is not operated. To prevent an error in determining the position because of refraction created due to the thickness of the quartz glass vessel, it is preferable to previously provide correcting means in the identifying means.

The image identification can be detected two-dimensionally or three-dimensionally, comparing to the actual production quality. Furthermore, lamp evaluating and screening means may be provided to evaluate and screen a lamp (e.g., a lamp in which the distance between the electrodes is outside the specification range, or the head shape of the electrode 9 is extremely deteriorated is regarded as a defect) as well during detection. This lamp evaluating and screening means can be configured with a computer including a program that can execute comparison and examination for lamp estimation and screening.

Thus, using the image identifying means 10, the relative positional relationship between the central position between the electrodes 9 and the position for setting of the luminous portion of the point-like light source in which the photodetector 7 provided in the light-entering position of an optical system for incident light for projection detects the maximum illuminance that is determined in the procedure (1) is identified and determined.

Next, referring to FIG. 3, the procedure (3) will be described below. In the procedure (3), as shown in FIG. 3, the position for setting in which the photodetector 7 detects the maximum illuminance that is determined in the procedure (1) is spatially matched to the predetermined position between the electrodes 9 determined in the procedure (2) with a second varying device 11. Then, the high pressure discharge lamp 8 is fixed to the reflecting mirror 1 with a cement material.

When fabricating a series of production apparatuses, the following method also can be used. A plurality of devices for evaluating and screening the reflecting mirror 1 for the procedure (1) and devices for evaluating and screening the lamp are prepared in parallel at the same time. The necessary positional information of the reflecting mirrors and the lamps that can be used as a non-defective product after screening is managed and controlled collectively. Then, a comparatively poor performance reflecting mirror 1 that is in the acceptable specification range may be combined with a comparatively good performance lamp that is in the acceptable specification range. This makes it possible to improve the yield further or plan and control the number of products of different ranks.

A parabolic mirror is more preferable than an ellipsoidal mirror as the reflecting mirror 1 used in the production method of this embodiment. This is because an ellipsoidal reflecting mirror provides high precision with more difficulty than a parabolic reflecting mirror. More specifically, in reflecting mirrors, a reflecting surface is generally produced by evaporation of a metal (e.g., Al), and since the depth (depth from the opening portion to the deepest portion) of the ellipsoidal mirror is larger than that of the parabolic mirror, it is more difficult to evaporate Al with high precision as designed for the ellipsoidal mirror than the parabolic mirror. The larger the discrepancy from the design is, the more significant the advantage provided by the production method of this embodiment including the step of determining the so-called champion point (that is, the position of the luminous portion in which the photodetector 7 indicates the maximum illuminance) of the reflecting mirror 1 is. Furthermore, since it is more difficult to produce smaller reflecting mirrors with high precision, the advantage of this embodiment is more significant. For example, it is preferable that the reflecting mirror 1 has a substantially ellipsoidal reflecting surface, and the maximum diameter of the reflecting surface of the reflecting mirror 1 is less than about 45 mm, preferably 40 mm or less.

In addition, it is preferable to use an HID lamp having higher intensity, especially, a high pressure mercury lamp as the high pressure discharge lamp 8 for a projector. This is because the advantage of the production method of this embodiment is more significant when it is necessary to produce a lamp unit having as high as an intensity to realize a very high performance projector than when a lamp unit that does not have to have a very high intensity is produced. It is preferable that the arc length of the high pressure mercury is 2 mm or less, and the amount of enclosed mercury of the high pressure mercury lamp is, for example, 150 mg/cm$^3$ or more (preferably, 200 mg/cm$^3$ or more) based on the inner volume of the luminous portion for a high intensity lamp suitable for a projector. When the bulb wall load is 80 W/cm$^2$ or more, the bulb wall temperature of the luminous bulb is increased sufficiently, and all enclosed mercury can be evaporated, thus resulting in a preferable light source for a projector.

In the case of such a short arc and a large amount of enclosed mercury, a phenomenon that mercury is coupled between the electrodes 9 (so-called mercury bridge) may occur. The mercury bridge can be prevented by displacing one electrode 9 with the other electrode 9. More specifically, in a high pressure mercury lamp (short arc type mercury lamp) in which the distance D between one electrode and the other electrode of a pair of electrodes is 2 mm or less, and the total mass of mercury enclosed is 150 mg/cm$^3$ or more, the shortest distance d (cm) between the head of one electrode and the head of other electrode can be larger than a value of $(6M/13.6\pi)^{1/3}$, where M (g) is the total mass of mercury enclosed. The countermeasure of the occurrence of mercury bridge is disclosed in Japanese Patent Application No. 2001-149500 (and its corresponding U.S. application Ser. No. 09/865,964), which are incorporated herein by reference.

Since in the design of a lamp unit, it is assumed that the high pressure discharge has electrodes whose axes are matched, there is a possibility that for the high pressure discharge lamp having displaced axes to prevent the mercury bridge or for any other reasons, the amount of light as desired cannot be obtained even if the luminous portion is provided in the position as designed. However, the production method of this embodiment can avoid this problem, because the position of the luminous portion that provides the maximum illuminance is determined, and then positioning is performed. Image identification performed by three-dimensional detection is preferable for the high pressure discharge lamp having displaced axes.

Furthermore, the high pressure discharge lamp 8 is not limited to a high pressure mercury lamp, but can be a metal halide lamp enclosing a metal halide, a xenon lamp or the like. In recent years, mercury-free metal halide lamps containing no mercury are under development, and such mercury metal halide lamps can be used.

The lamp unit obtained by the production method of this embodiment can be formed into an image projecting apparatus by combining with an optical system including an image device (DMD (Digital Micromirror Device) panels or liquid crystal panels). For example, a projector (digital light processing (DLP) projectors) using DMDs or liquid crystal projectors (including reflective projectors using a LCOS (Liquid Crystal on Silicon) structure) can be provided. Furthermore, the lamp unit obtained by the production method of this embodiment can be used preferably, not only as a light source of an image projecting apparatus, but also for other applications, such as a light source for ultraviolet ray steppers or a light source for sport stadium, a light source for automobile headlights, and a floodlight for illuminating traffic signs.

According to the production method of this embodiment of the present invention, there is no need of operating a high pressure lamp to be fixed, so that the work time can be significantly reduced, compared to a conventional method. For example, for the purpose of determining whether or not a product is non-defective or defective or other purposes, it is of course possible that the high pressure discharge lamp is operated in the production method of this embodiment. In addition, it is possible to evaluate and screen the characteristics of a lamp or a reflecting mirror alone, so that the present invention can contribute to improvement of the yield in the production process. Moreover, if a plurality of devices for evaluating and screening the reflecting mirror and devices for evaluating and screening the lamp are prepared in parallel at the same time when fabricating a series of producing apparatuses, the yield can be improved further or the number of products of different ranks can be planed and controlled.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A method for producing a high pressure discharge lamp unit including a high pressure discharge lamp set and fixed to a reflecting mirror comprising the steps of:

detecting light released from a point-like light source and reflected at a reflecting surface of the reflecting mirror to determine a position for setting that is a position of the point-like light source in which the reflected light is substantially a maximum;

identifying a predetermined position between electrodes of the high pressure discharge lamp; and matching the predetermined position to the position for setting.

2. The method for producing a high pressure discharge lamp unit according to claim 1, wherein the step of identifying a predetermined position comprises the step of identifying the predetermined position as three-dimensional information.

3. The method for producing a high pressure discharge lamp unit according to claim 2, wherein the step of identifying a predetermined position comprises the step of further identifying an electrode shape of the high pressure discharge lamp as three-dimensional information.

4. The method for producing a high pressure discharge lamp unit according to claim 1, further comprising the step of evaluating and screening the high pressure discharge lamp in accordance with a predetermined criterion, based on information on the predetermined position that is identified.

5. The method for producing a high pressure discharge lamp unit according to claim 1, wherein the step of determining a position for setting comprises the step of detecting the reflected light as two-dimensional information.

6. The method for producing a high pressure discharge lamp unit according to claim 5, further comprising the step of combining a single high pressure discharge lamp and a single reflecting mirror in accordance with a predetermined criterion among a plurality of high pressure discharge lamps and a plurality of reflecting mirrors, based on information on the predetermined position that is identified and information on the reflected light that is detected.

7. The method for producing a high pressure discharge lamp unit according to claim 1, further comprising the step of evaluating and screening the reflecting mirror in accordance with a predetermined criterion, based on information on the reflected light that is detected.

8. The method for producing a high pressure discharge lamp unit according to claim 1, wherein the reflecting mirror has a substantially ellipsoidal reflecting surface, and a maximum diameter of the reflecting surface of the reflecting mirror is less than 40 mm.

9. An apparatus for producing a high pressure discharge lamp unit including a high pressure discharge lamp set and fixed to a reflecting mirror comprising:

a point-like light source;

a first varying device for varying a position of the point-like light source;

a detecting device for detecting light emitted from the point-like light source and reflected at a reflecting surface of the reflecting mirror;

an identifying device for identifying a predetermined position between electrodes of the high pressure discharge lamp; and a second varying device for matching the predetermined position to a position for setting that is a position of the point-like light source determined by the detecting device in which the reflected light is substantially a maximum.

10. The apparatus for producing a high pressure discharge lamp unit according to claim 9, wherein the identifying device has a function of identifying the predetermined position between electrodes of the high pressure discharge lamp as three-dimensional information.

11. The apparatus for producing a high pressure discharge lamp unit according to claim 10, wherein the identifying device has a function of further identifying an electrode shape of the high pressure discharge lamp as three-dimensional information.

12. The apparatus for producing a high pressure discharge lamp unit according to claim 9, further comprising lamp evaluating and screening means for evaluating and screening the high pressure discharge lamp in accordance with a predetermined criterion, based on information identified by the identifying device.

13. The apparatus for producing a high pressure discharge lamp unit according to claim 9, wherein the detecting device has a function of detecting the reflected light as two-dimensional information.

14. The apparatus for producing a high pressure discharge lamp unit according to claim 13, further comprising combination instructing means for combining a single high pressure discharge lamp and a single reflecting mirror in accordance with a predetermined criterion among a plurality of high pressure discharge lamps and a plurality of reflecting mirrors, based on information from the lamp evaluating and screening means and the reflecting mirror evaluating and screening means.

15. The apparatus for producing a high pressure discharge lamp unit according to claim 9, further comprising reflecting mirror evaluating and screening means for evaluating and screening the reflecting mirror in accordance with a predetermined criterion, based on information detected by the detecting device.

* * * * *